United States Patent [19]

Moore

[11] 3,948,187

[45] Apr. 6, 1976

[54] POWER AND FREE CONVEYOR SYSTEM

[75] Inventor: Guy R. Moore, Burlington, Canada

[73] Assignee: Welland Forge Limited, Welland, Canada

[22] Filed: Oct. 9, 1974

[21] Appl. No.: 513,277

[30] Foreign Application Priority Data

Oct. 10, 1973 Canada ..... 183048

[52] U.S. Cl. ..... 104/250; 104/252; 198/232

[51] Int. Cl.[2] ..... B61K 7/16

[58] Field of Search..... 104/249, 250, 252, 172 R, 104/172 S, 178, 179, 89; 198/232

[56] References Cited

UNITED STATES PATENTS

| | | | |
|---|---|---|---|
| 1,806,913 | 5/1931 | Paquette | 198/232 |
| 3,149,715 | 9/1964 | Massimiani | 104/249 X |
| 3,559,585 | 2/1971 | Lempio | 104/172 S |

*Primary Examiner*—Robert J. Spar
*Assistant Examiner*—Randolph A. Reese
*Attorney, Agent, or Firm*—Barnes, Kisselle, Raisch & Choate

[57] ABSTRACT

A conveyor comprising a track, at least one carrier movable along the track, and a conveyor for driving the carrier along the track. A device is provided along the track and is responsive to the speed of the carrier along the track to stop the carrier when the speed exceeds a predetermined value.

14 Claims, 7 Drawing Figures

POWER AND FREE CONVEYOR SYSTEM

This invention relates to power and free conveyor systems.

BACKGROUND OF THE INVENTION

In power and free conveyor systems, it is common to have a plurality of carriers that are movable along a track by engagement with a conveyor chain. In instances where the track is inclined, if the conveyor is broken or the engagement with the carriers is otherwise released, it is possible that the carrier may move in an unrestrained fashion down the incline. It is therefore desirable to have a stop device that will function in such an eventuality of a break in the connection between the conveyor and the carrier.

Accordingly, among the objects of the invention are to provide a conveyor system which incorporates a simple and effective automatic stop which will function to stop the carrier in the event of a break in the driving connection between the chain and the carrier.

SUMMARY OF THE INVENTION

The conveyor system embodying the invention comprises a track, at least one carrier movable along the track, a conveyor for driving said carrier along said track, and means along said track responsive to the speed of the carrier along said track to stop the carrier when the speed exceeds a predetermined value.

DESCRIPTION

Figure 1:
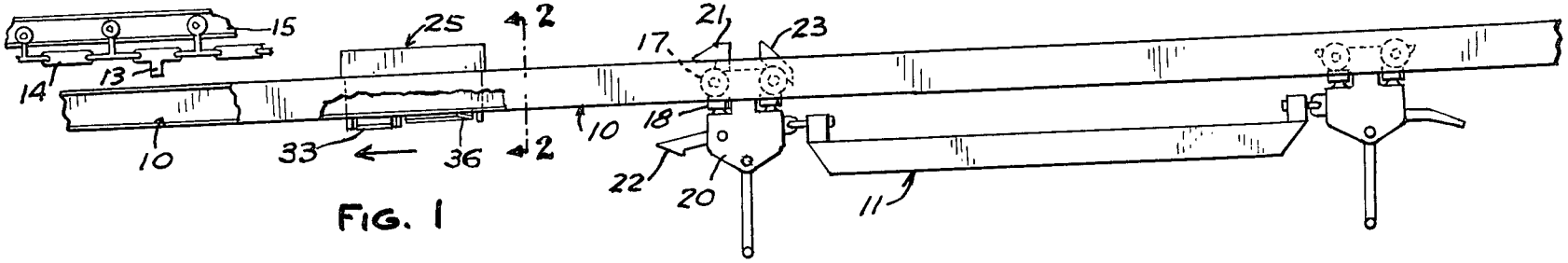
FIG. 1 is a partly diagrammatic side elevational view of a conveyor system embodying the invention.

Referring to FIG. 1, the conveyor system comprises a track 10 which is inclined downwardly along which carriers 11 are moved in the direction of the arrow, namely from right to left, by engagement of a pusher dog 13 on a conveyor chain 14 riding along a conveyor chain track 15.

Figure 2:
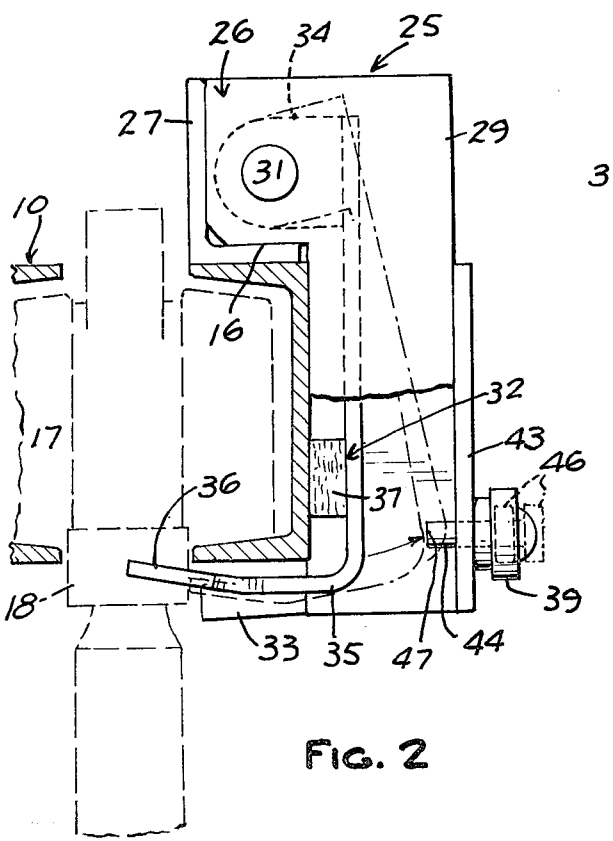
FIG. 2 is a fragmentary sectional view on an enlarged scale taken along the line 2—2 in FIG. 1.

As shown in FIG. 2, the track 10 comprises inwardly facing channels 16, the lower flanges of which are engaged by rollers 17 of the carriers. The carriers further include vertical guide rollers 18. The leading trolley 20 of the carrier 11 includes a pusher dog 21 that is movable generally vertically within the body of the trolley and is adapted to be engaged by the pusher 13 on the conveyor chain 14. A lever 22 extends forwardly and is interconnected to the pusher 21 to retract the pusher upon engagement with an obstacle or a preceding carrier. A holdback dog 23 is also provided on the trolley. The aforementioned construction is conventional and is shown, for example, in U.S. Pat. No. 3,548,752.

In accordance with the invention, a stop device 25 is provided along the track 10 and is operable upon the carrier 11 moving at a predetermined speed to stop the carrier, such as might occur when the carrier connection to the chain is broken or interrupted as by breakage of the chain.

Figure 3:
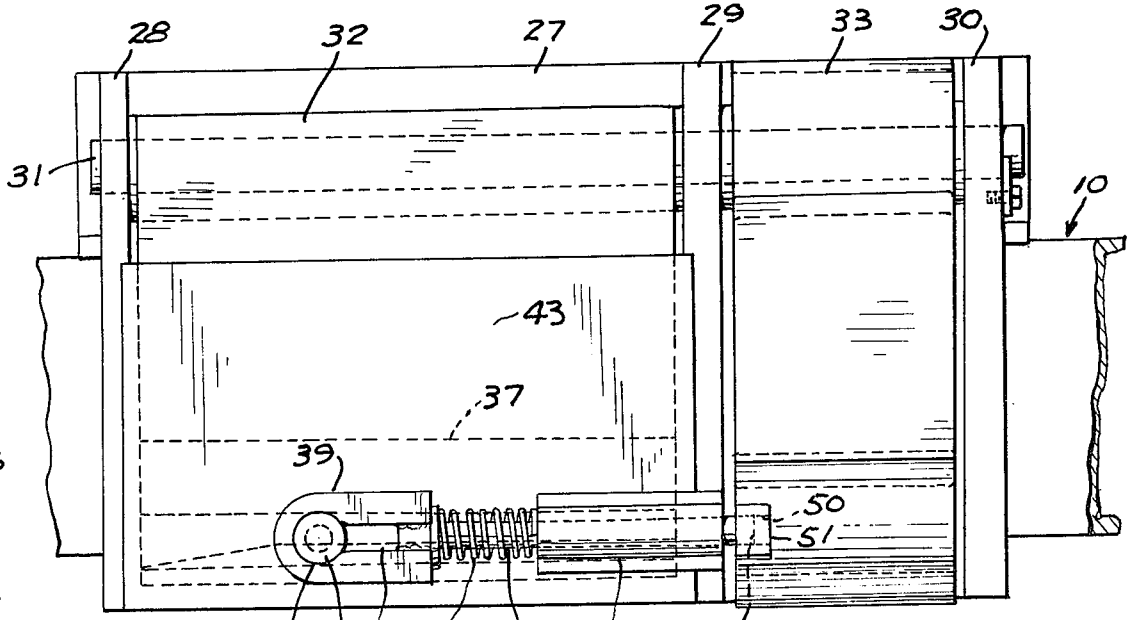
FIG. 3 is a fragmentary side elevational view of the portion of the system shown in FIG. 2.

Referring to FIGS. 2 and 3, the stop device 25 comprises a frame 26 including an angle member 27 and spaced laterally extending walls 28, 29, 30. A shaft 31 extends between the walls 28, 29, 30 along the track. A first member 32 is pivoted on the shaft 31 between the walls 28, 29 and a second member 33 is pivoted on the shaft 31 between the walls 29, 30. First member 32 functions as a tripper dog and is generally L-shaped in cross section as shown in FIG. 2, being supported on the shaft 31 by wings or flanges 34. The lower portion 35 of member 32 includes an inclined surface 36 that is normally in the path of the carrier 11 and particularly the leading roller 18. As the carrier is moved past the stop device, the tripper member 32 is swung outwardly, the degree of outward swinging movement or lateral movement being dependent upon the speed of the carrier. A pad 37 functions to absorb the shock as the member 32 returns under the action of gravity back to its normal position in the path of the carrier.

The second member 33 functions as a stop and is normally held out of the path of the carrier by a latching device that includes a latch pin 38 that has yoke 39 fixed to one end thereof, the yoke 39 having an enlarged circular opening 40 connected with a slot 41. Latch pin 38 passes through a guide 42 fixed on the plate 43 extending between the walls 28, 29 and has a spring 43 thereon which functions as presently described. A release pin 44 extends laterally through the opening 45 in plate 43 and has an enlarged head 46 normally engaging the enlarged opening 40 in the yoke 39. The free end 47 of the pin is in the path of the tripper member 32 (FIG. 2). In the normal position, the spring is interposed between the guide 42 and a washer 48 and the head or enlarged portion 46 prevents the latch pin from being released and holds the end 49 of the pin in engagement with opening 50 of a locking member 51 on the stop device 33.

Figure 4:
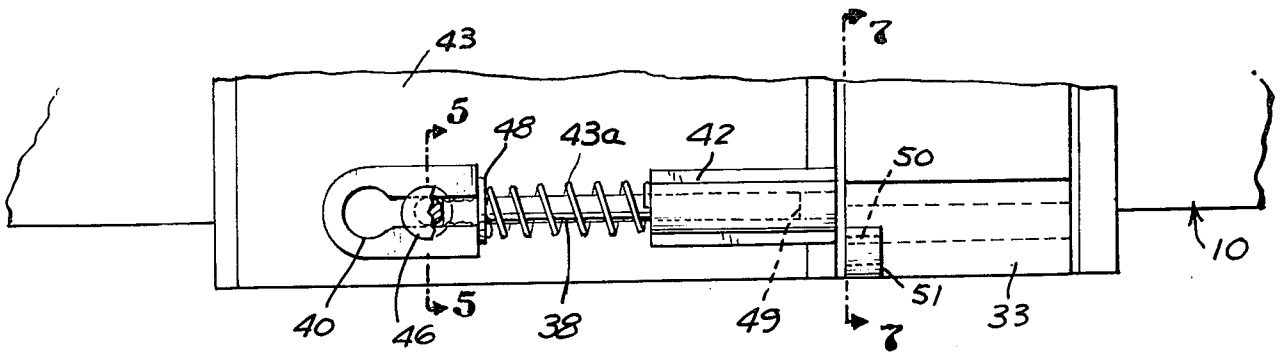
FIG. 4 is a fragmentary view similar to FIG. 3 showing the parts in a different operative position.
Figure 7:
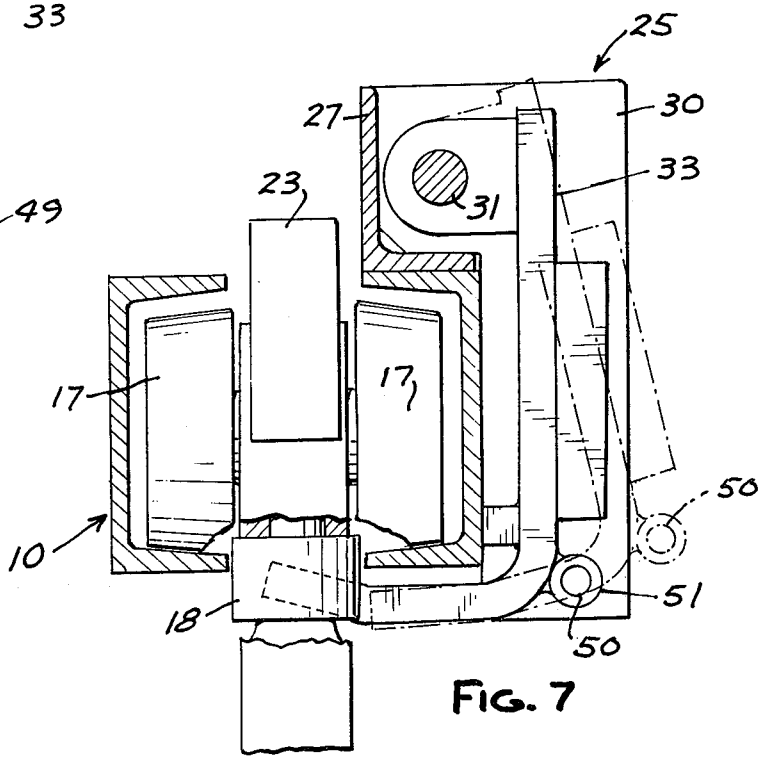
FIG. 7 is a fragmentary sectional view taken along the line 7—7 in FIG. 4.
Figure 6:
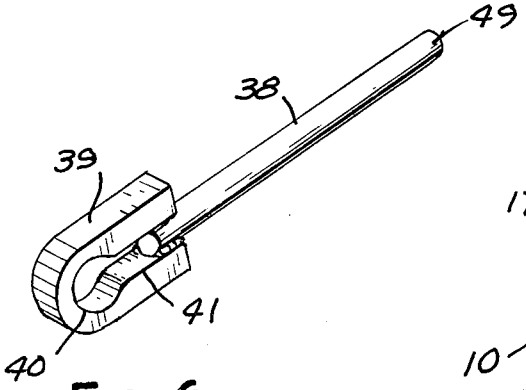
FIG. 6 is a perspective view of a part of the system.
Figure 5:
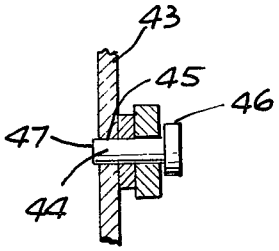
FIG. 5 is a fragmentary sectional view taken along the line 5—5 in FIG. 4.

If the carrier is released and moves with sufficient speed past the trip dog 32, the trip dog 32 is swung outwardly sufficiently, to the broken line position in FIG. 2, to engage the pin 44 and release the enlarged portion 46 from the yoke 39 permitting the spring 43 to move the latch pin 38 to the left as viewed in FIG. 4, releasing the stop 33 and permitting it to move under the action of gravity into the path of the carrier to stop the carrier.

This same movement may be used to actuate an alarm or signal indicating to the operator that there is a breakage in the chain. After appropriate repair to the chain, the stop 33 can be reset manually to the position wherein the stop 33 is held out of the path of the carrier.

I claim:

1. In a conveyor system, the combination comprising a track, at least one carrier movable along said track, a conveyor for driving said carrier along said track, and means along said track responsive to the speed of said carrier along said track to stop said carrier when the speed exceeds a predetermined value, said last-mentioned means comprising a first member mounted in the path of the carrier and engagable by the carrier as it moves along said track, a second member normally held out of the path of the carrier, said first member being held in the path of the carrier by gravity, latch means for holding said second member out of the path of said carrier, said second member being movable upon release of said latch means under the action of gravity into the path of said carrier, and means responsive to the lateral movement of said first member to release said latch means when the carrier speed exceeds a predetermined value.

2. The combination set forth in claim 1 wherein said latch means comprises a latch pin on said track normally engaging said second member, and means operable upon sufficient lateral movement of said first member to disengage said pin.

3. The combination set forth in claim 2 wherein said last-mentioned means comprises a release pin engaging said latch pin, said release pin being engageable by said first member to disengage said latch pin.

4. The combination set forth in claim 3 wherein said latch pin includes a yoke, said release pin engaging a portion of said yoke.

5. The combination set forth in claim 4 wherein said yoke has an enlarged opening therein, said release pin having an enlarged portion engaging said opening.

6. The combination set forth in claim 5 wherein said yoke has an elongated slot whereby when the enlarged portion of said release pin is released from said enlarged opening, said latch pin may move relative to said release pin along said slot.

7. The combination set forth in claim 6 including spring means tending to normally urge said latch pin out of engagement with said second member.

8. For use in a conveyor system having a track, at least one carrier movable along said track, and a conveyor for driving said carrier along said track, means adapted to be mounted along said track and responsive to the speed of said carrier along said track to stop said carrier when the speed exceeds a predetermined value, said last-mentioned means comprising a first member adapted to be mounted in the path of the carrier and engagable by the carrier as it moves along said track, a second member adapted to be normally held out of the path of the carrier, said first member being adapted to be held in the path of the carrier by gravity, latch means for holding said second member out of the path of said carrier, said second member being movable upon release of said latch means under the action gravity into the path of said carrier, and means responsive to the lateral movement of said first member to release said latch means when the carrier speed exceeds a predetermined value.

9. The combination set forth in claim 8 wherein said latch means comprises a latch pin on said track normally engaging said second member, and means operable upon sufficient lateral movement of said first member to disengage said pin.

10. The combination set forth in claim 9 wherein said last-mentioned means comprises a release pin engaging said latch pin, said release pin being engageable by said first member to disengage said latch pin.

11. The combination set forth in claim 10 wherein said latch pin includes a yoke, said release pin engaging a portion of said yoke.

12. The combination set forth in claim 11 wherein said yoke has an enlarged opening therein, said release pin having an enlarged portion engaging said opening.

13. The combination set forth in claim 12 wherein said yoke has an elongated slot whereby when the enlarged portion of said release pin is released from said enlarged opening, said latch pin may move relative to said release pin along said slot.

14. The combination set forth in claim 13 including spring means tending to normally urge said latch pin out of engagement with said second member.

* * * * *